US007270556B2

(12) United States Patent
Mori et al.

(10) Patent No.: US 7,270,556 B2
(45) Date of Patent: Sep. 18, 2007

(54) WATERPROOF CONNECTOR

(75) Inventors: Fumikatsu Mori, Aichi-ken (JP); Harehide Sasaki, Aichi-ken (JP); Yoshiaki Kato, Aichi-ken (JP); Masato Minakata, Toyota (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 11/453,135

(22) Filed: Jun. 15, 2006

(65) Prior Publication Data

US 2007/0004279 A1 Jan. 4, 2007

(30) Foreign Application Priority Data

Jun. 21, 2005 (JP) ..... 2005-180814

(51) Int. Cl.
*H01R 13/52* (2006.01)

(52) U.S. Cl. ..... 439/272

(58) Field of Classification Search ..... 439/271, 439/275, 587

See application file for complete search history.

(56) References Cited

U.S. PATENT DOCUMENTS 4,944,688 A * 7/1990 Lundergan ..... 439/275
5,226,832 A * 7/1993 Dejardin et al. ..... 439/274
5,551,892 A * 9/1996 Endo et al. ..... 439/587
6,527,574 B1 * 3/2003 Murakami et al. ..... 439/275

* cited by examiner

*Primary Examiner*—Briggitte R Hammond
(74) *Attorney, Agent, or Firm*—Roberts, Mlotkowski & Hobbes; Thomas W. Cole

(57) ABSTRACT

A waterproof connector has a housing formed with holding portions capable of holding terminal fittings, and formed at one end with a fitting hole into which electric wires connected to the held terminal fittings are inserted; a waterproof plug having first electric wire insertion holes corresponding to the holding portions and fitted into the fitting hole; and a holder having a body portion preventing the waterproof plug from detaching from the housing and provided on the opposite side of the waterproof plug to the terminal fittings. The body portion of the holder is formed with second electric wire insertion holes into which the electric wires inserted into the first electric wire insertion holes are inserted. Further, the body portion is formed integrally with fitting protrusions that fit into the unused first electric wire insertion holes, thereby preventing drops of water from entering the housing through the unused first electric wire insertion holes.

1 Claim, 12 Drawing Sheets

WATERPROOF CONNECTOR

CROSS-REFERENCE TO RELATED APPLICATION

This application claims priority under 35 USC 119 from Japanese Patent Application No. 2005-180814, the disclosure of which is incorporated by reference herein.

TECHNICAL FIELD

The present invention relates to a waterproof connector.

RELATED ART

A waterproof connector is known in which electric wires are connected to plural terminal fittings provided in a housing through a hole portion formed at one end of the housing, and a rubber waterproof plug formed with plural electric wire insertion holes into which the electric wires are inserted is fitted in the hole portion of the housing, thereby preventing drops of water from entering the housing through the hole portion (for instance, see Japanese Patent Application Laid-Open (JP-A) No. 9-17498).

In such a waterproof connector, plural (for instance, six) holding holes capable of holding the terminal fittings are formed in the housing, and plural electric wire insertion holes are formed in the waterproof plug in such a manner so as to correspond to the plural holding holes.

In the above-structured waterproof connector, the terminal fittings can be fitted only in some (for instance, three) of the plural holding holes depending on operating conditions. In such case, the electric wire insertion holes corresponding to the holding holes fitted with the terminal fittings, of the plural electric wire insertion holes of the waterproof plug are closed by inserting the electric wires thereinto. The remaining unused electric wire insertion holes remain open. Drops of water can enter the housing through the unused electric wire insertion holes.

The unused electric wire insertion holes need be closed by inserting thereinto specially-set sealing pins as separate components, which causes the number of components to be increased. Further, the sealing pins need be inserted into the unused electric wire insertion holes, respectively, which causes the number of assembling processes to be increased.

SUMMARY

In consideration of the above facts, the present invention provides a waterproof connector which can prevent drops of water from entering a housing through unused electric wire insertion holes of a waterproof plug and can prevent the number of components and the number of assembling processes from being increased.

According to one aspect of the invention, a waterproof connector has a housing formed therein with plural holding portions capable of holding terminal fittings so that predetermined some of the plural holding portions hold the terminal fittings, and formed at one end with a fitting hole communicating the plural holding portions with the outside, with electric wires connected to the held terminal fittings being inserted thereinto; a waterproof plug fitted in the fitting hole, having plural first electric wire insertion holes formed corresponding to the plural holding portions so that the electric wires are inserted into the first electric wire insertion holes corresponding to the predetermined some of the holding portions holding the terminal fittings, and preventing drops of water from entering the housing through the fitting hole from points other than the unused first electric wire insertion holes into which the electric wires are not inserted; and a holder provided on the opposite side of the terminal fittings through the waterproof plug, having a body portion engaged to the one end of the housing so as to prevent the waterproof plug from falling from the housing, second electric wire insertion holes formed in the body portion, with the electric wires inserted into the first electric wire insertion holes being inserted thereinto, and fitting protrusions integrally formed in the body portion to be fitted in the unused first electric wire insertion holes, and preventing drops of water from entering the housing through the unused first electric wire insertion holes.

Other aspects, features and advantages of the invention will become apparent from the following description taken in conjunction with the accompanying drawings.

BRIEF DESCRIPTION OF THE DRAWINGS

Embodiments of the invention will be described in detail based on the following figures, in which.

DETAILED DESCRIPTION

Figure 1:
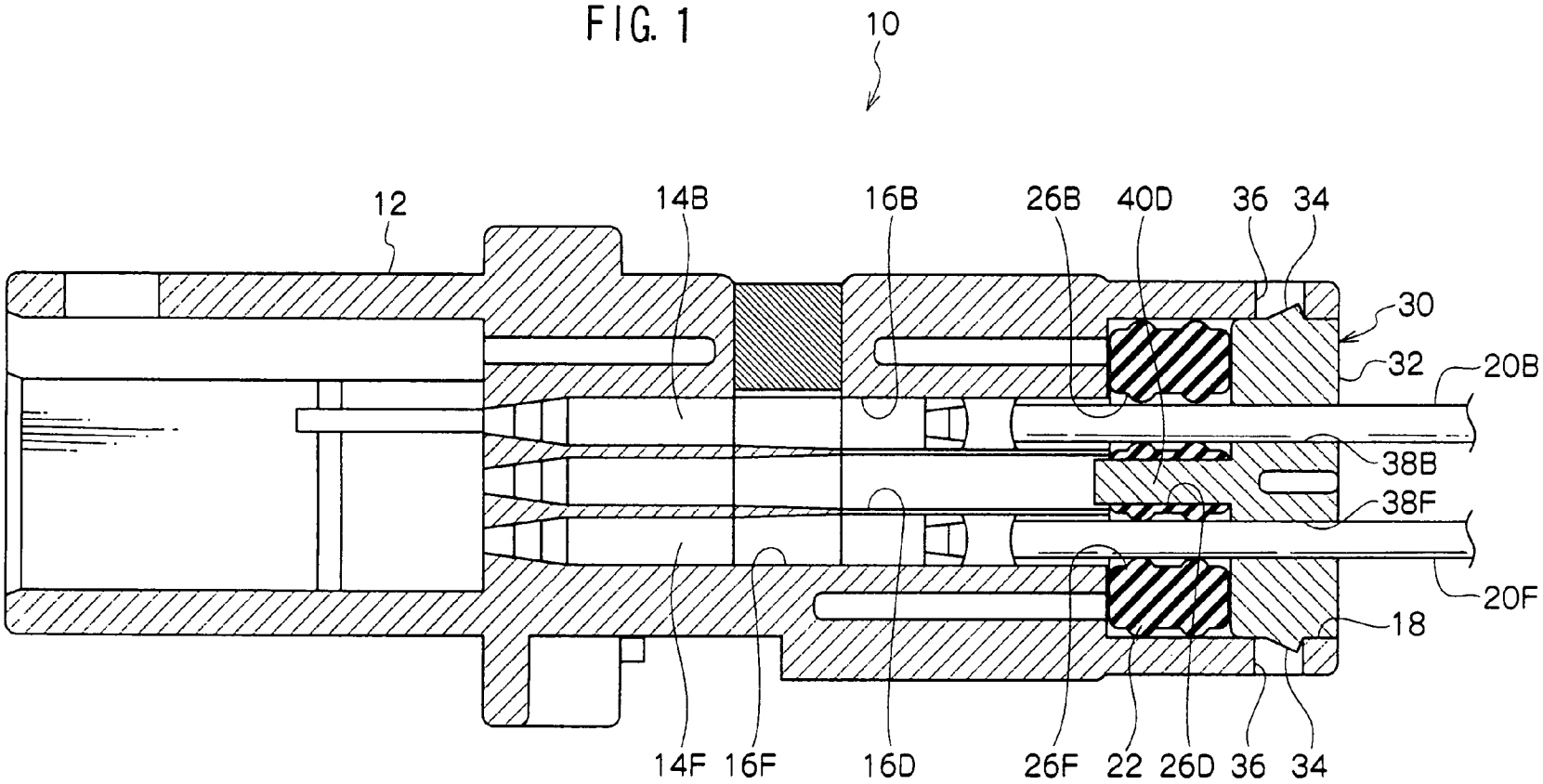
FIG. 1 is a longitudinal sectional view showing the structure of a waterproof connector according to an embodiment of the invention.
Figure 2:
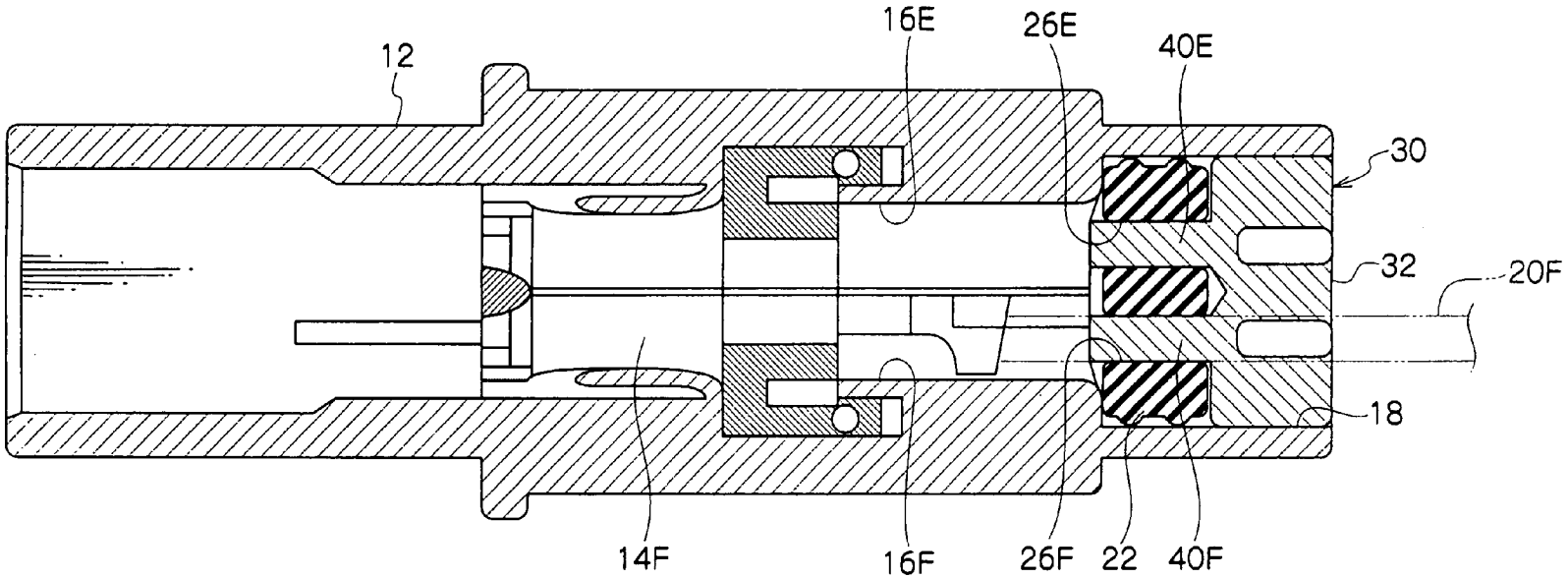
FIG. 2 is a transverse sectional view showing the structure of the waterproof connector according to the embodiment of the invention.

FIG. 1 is a longitudinal sectional view showing the structure of a waterproof connector 10 according to an embodiment of the invention. FIG. 2 is a transverse sectional view showing the structure of the waterproof connector 10.

Figure 3:
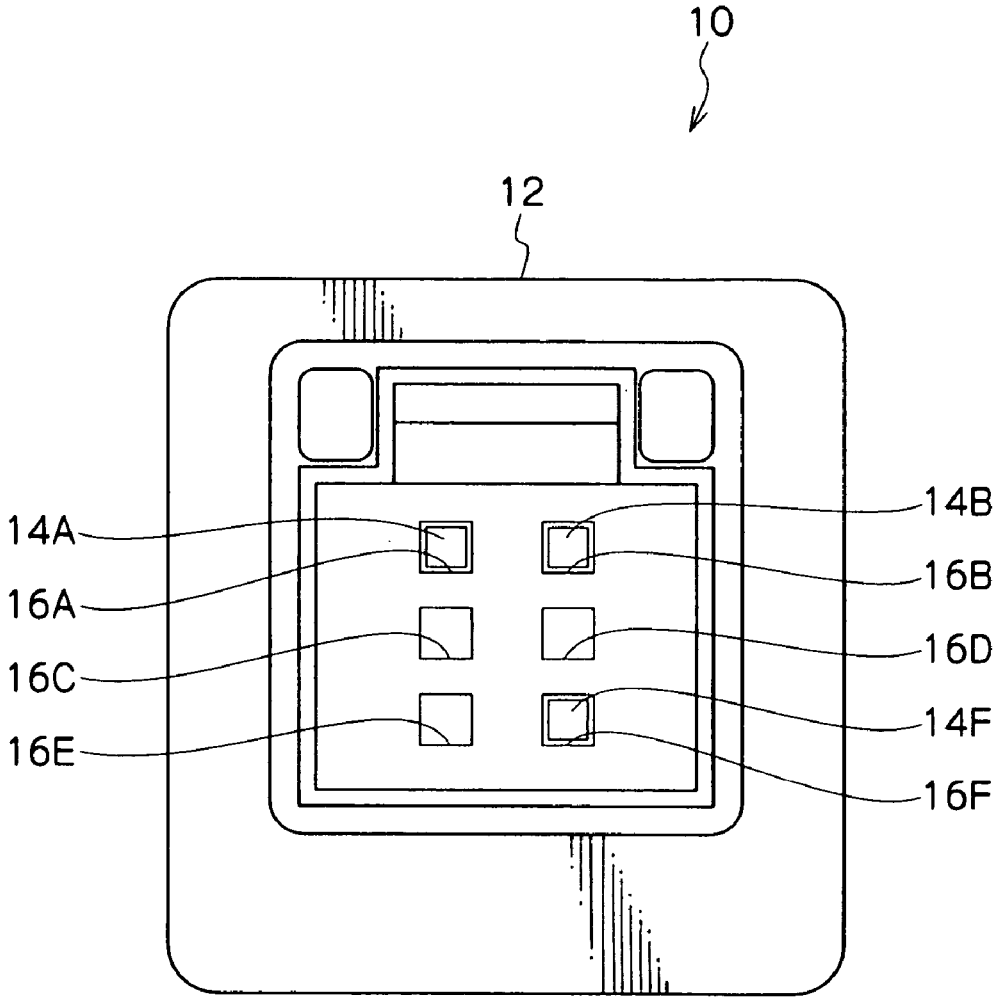
FIG. 3 is a left side view showing the structure of the waterproof connector according to the embodiment of the invention.
Figure 4:
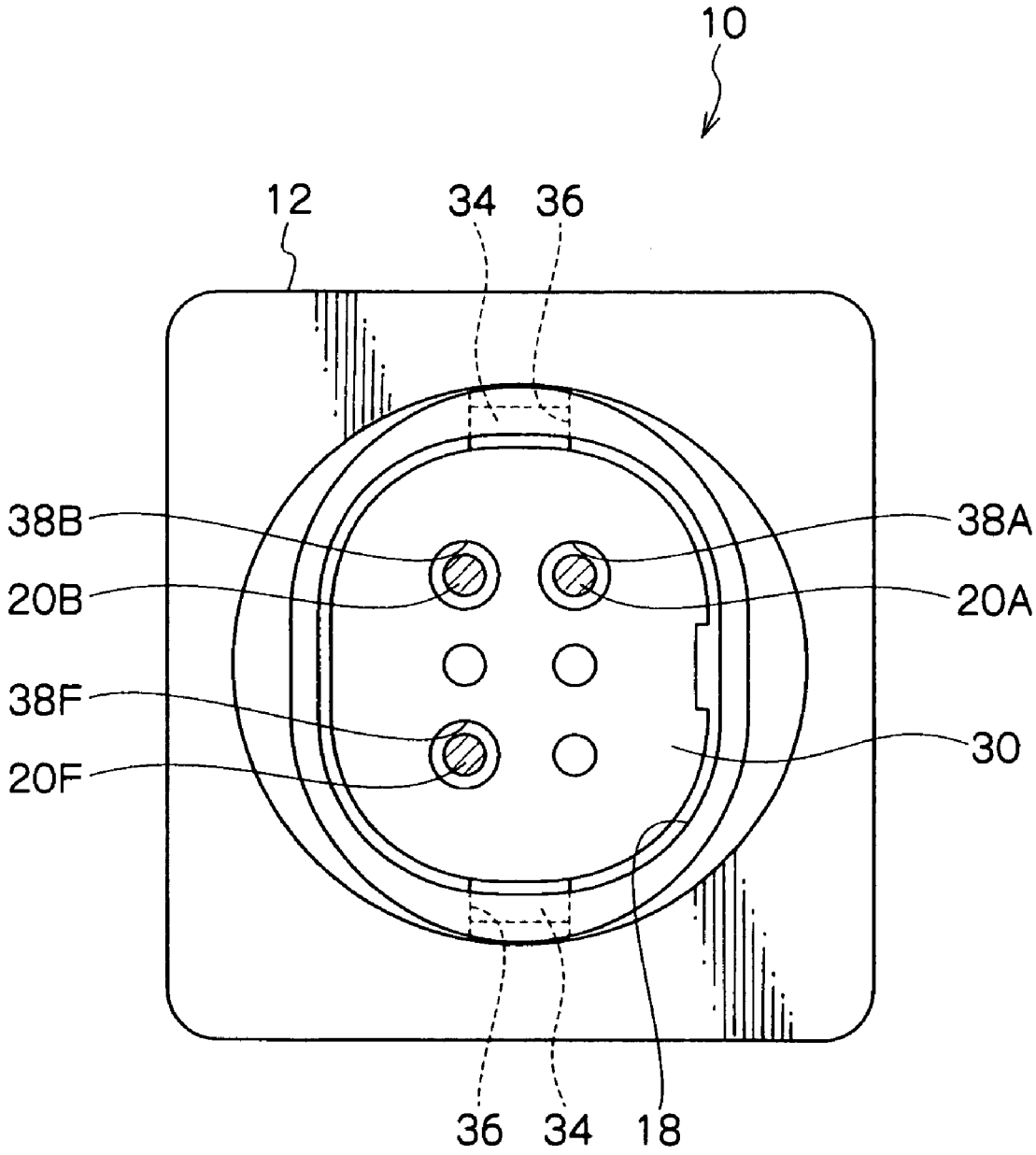
FIG. 4 is a right side view showing the structure of the waterproof connector according to the embodiment of the invention.

FIG. 3 is a left side view showing the structure of the waterproof connector 10. FIG. 4 is a right side view showing the structure of the waterproof connector 10.

The waterproof connector 10 has a housing 12 formed of a resin material. The housing 12 is formed therein with plural (in this embodiment, six) holding holes 16A, 16B, 16C, 16D, 16E, and 16F as holding portions capable of holding terminal fittings 14. The holding holes 16A, 16B, 16C, 16D, 16E, and 16F are arrayed in two rows and three columns. The holding holes 16A, 16B, and 16F hold the terminal fittings 14A, 14B, and 14F, respectively.

The housing 12 is formed at its right end with a fitting hole 18 of elliptical cross section. The fitting hole 18 communicates the six holding holes 16A, 16B, 16C, 16D, 16E, and 16F with the outside. Three electric wires 20A, 20B, and 20F connected to the terminal fittings 14A, 14B, and 14F are inserted into the fitting hole 18.

Figure 5:
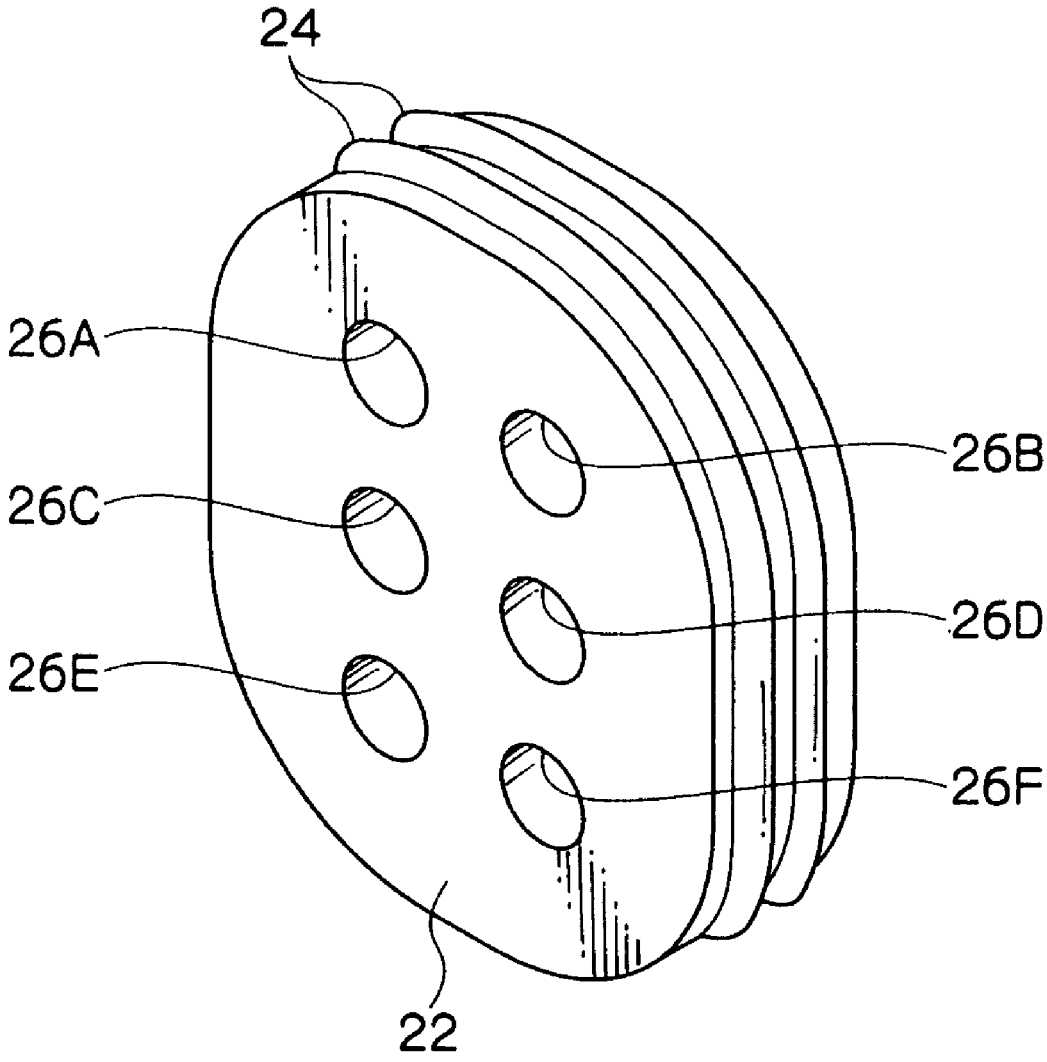
FIG. 5 is a perspective view showing the structure of a waterproof plug as a constructing member of the waterproof connector according to the embodiment of the invention.
Figure 6:
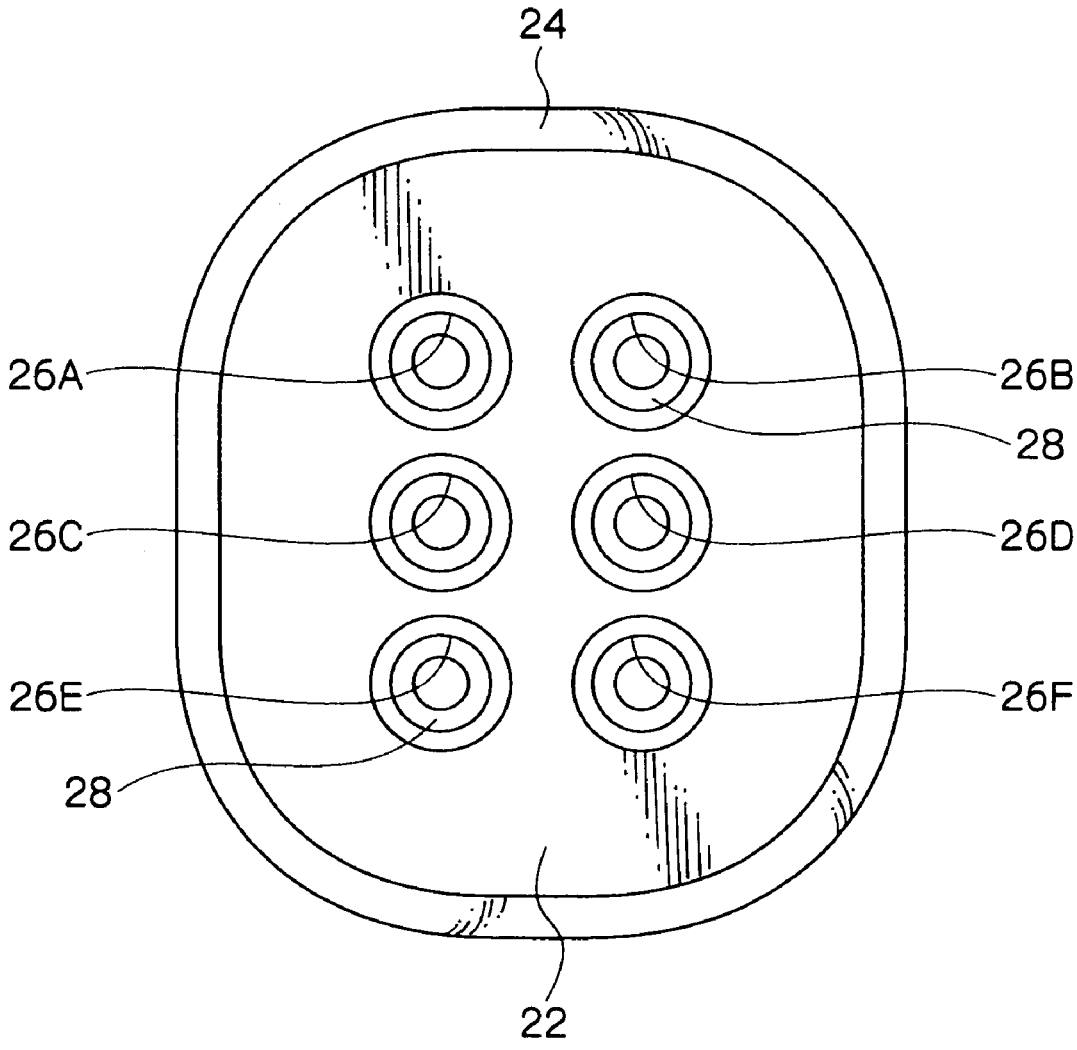
FIG. 6 is a front view showing the structure of the waterproof plug as a constructing member of the waterproof connector according to the embodiment of the invention.
Figure 7:
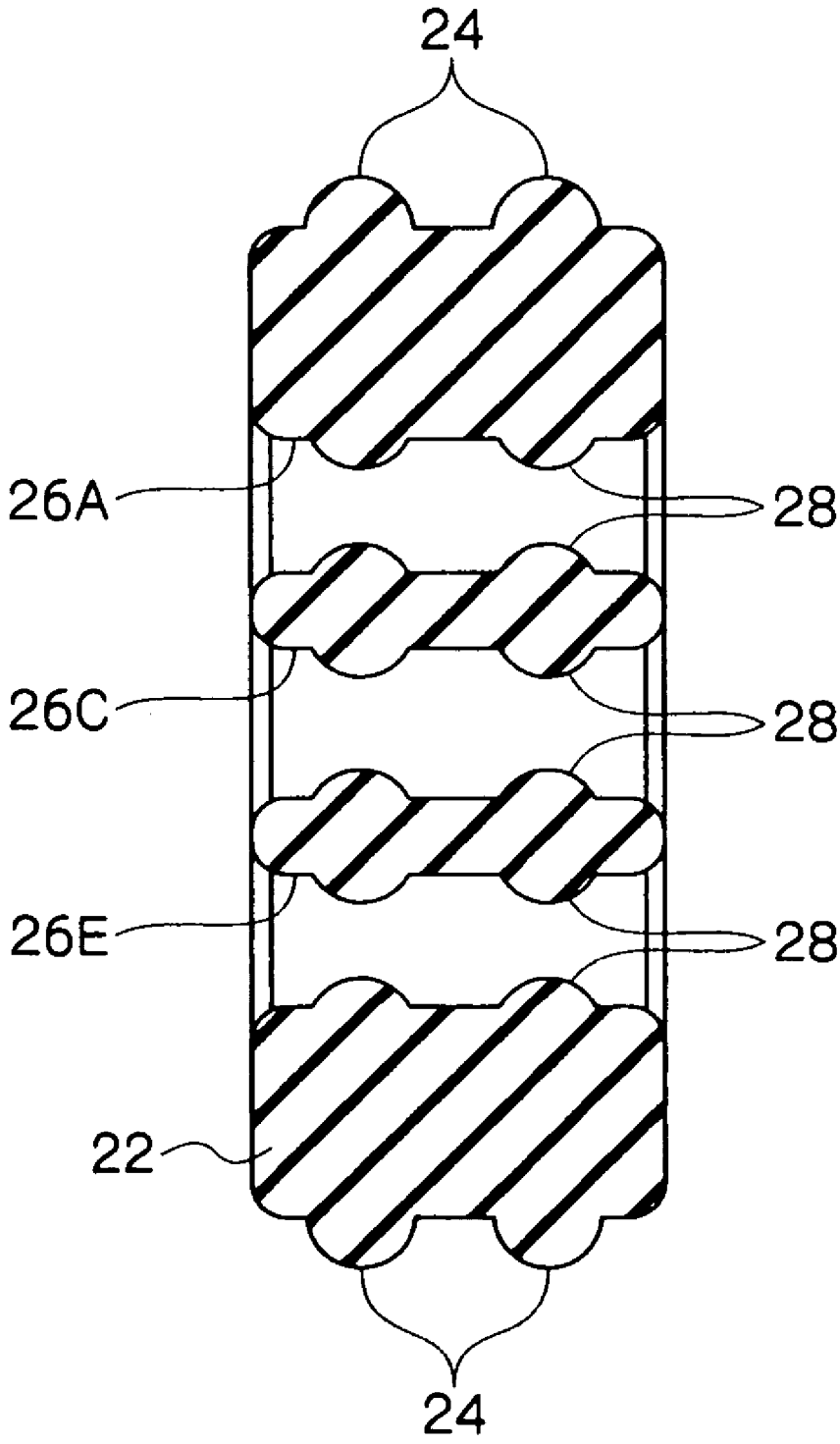
FIG. 7 is a cross-sectional view showing the structure of the waterproof plug as a constructing member of the waterproof connector according to the embodiment of the invention.
Figure 8:
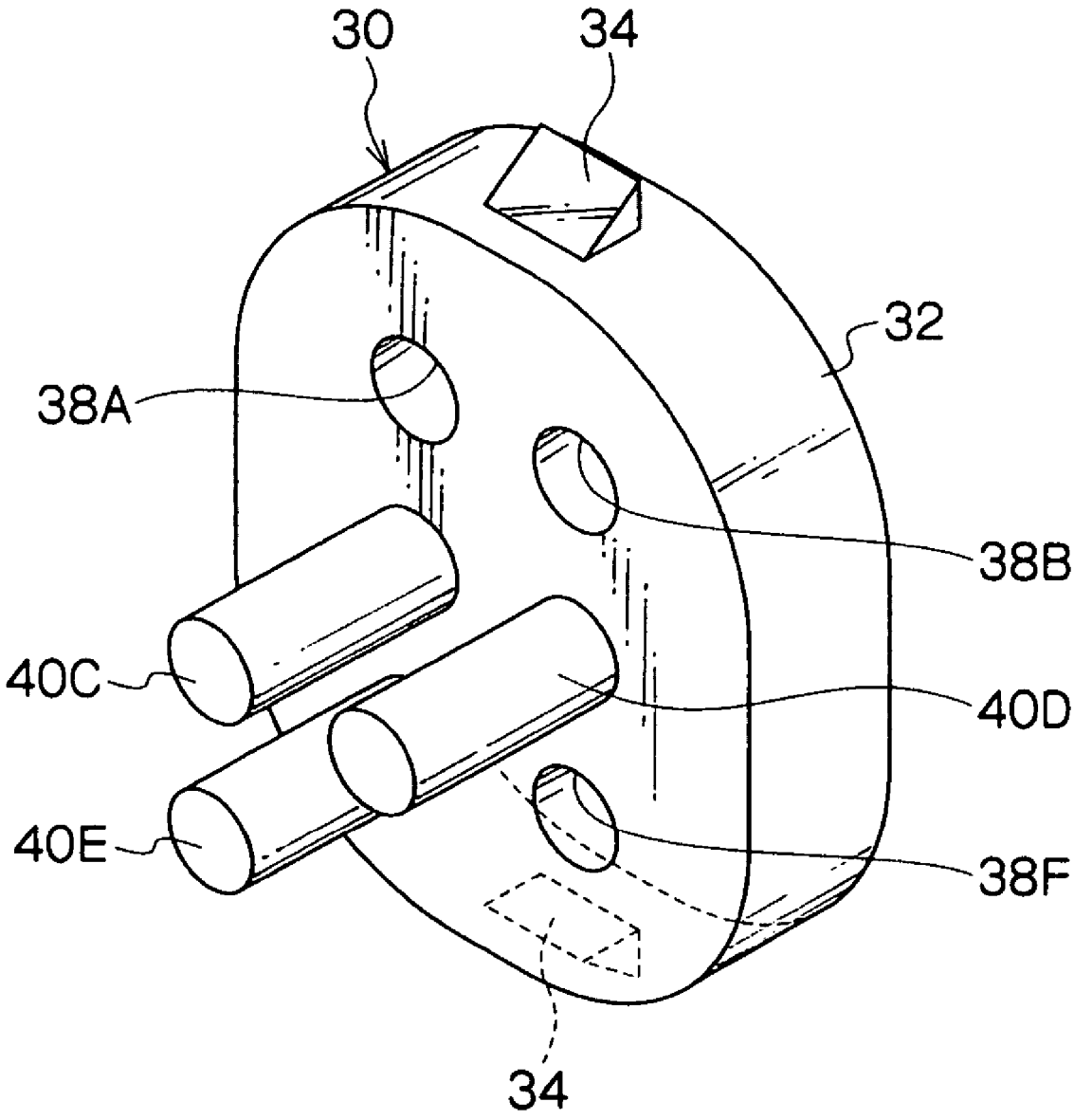
FIG. 8 is a perspective view showing the structure of a holder as a constructing member of the waterproof connector according to the embodiment of the invention.
Figure 9:
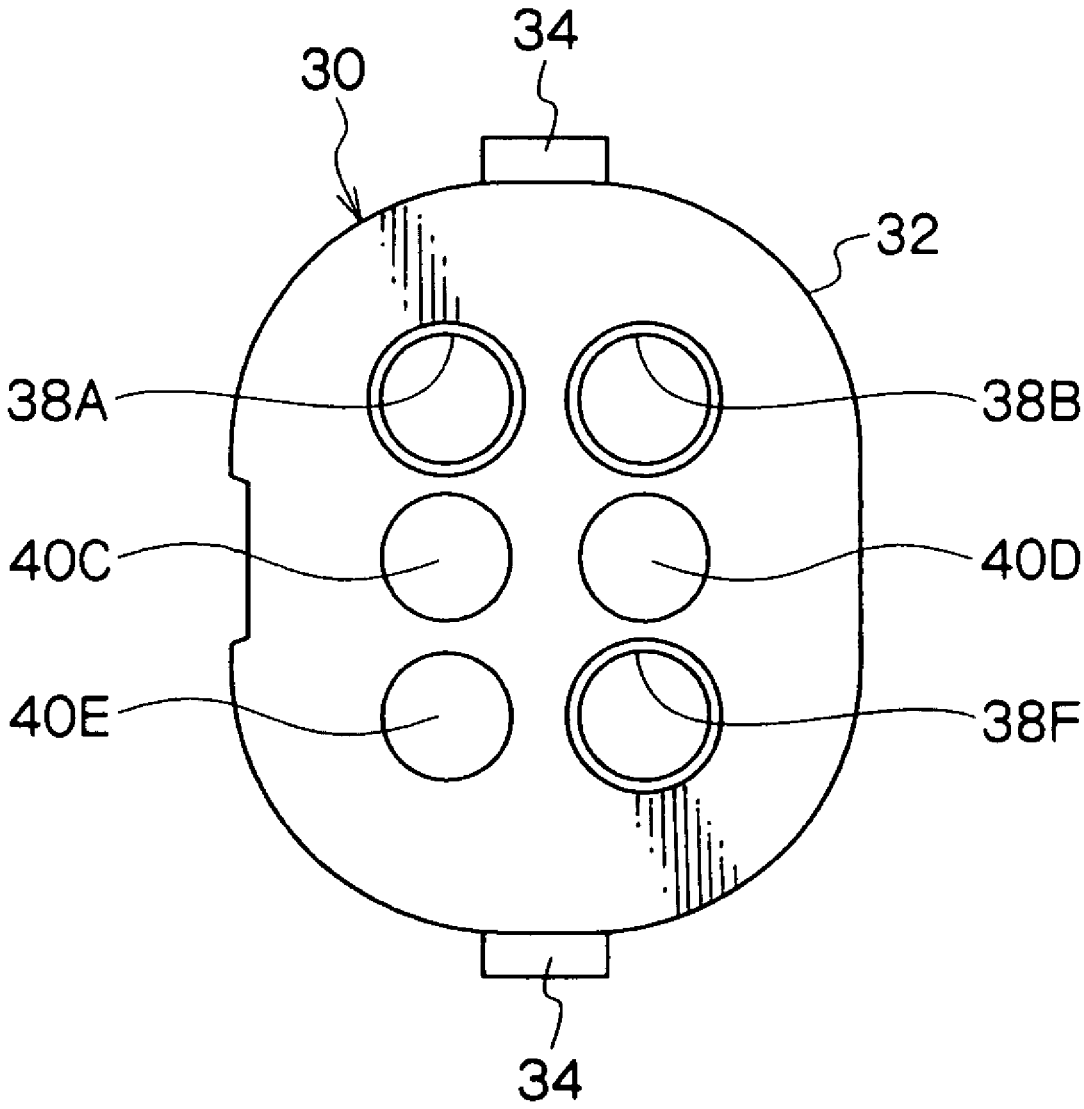
FIG. 9 is a front view showing the structure of the holder as a constructing member of the waterproof connector according to the embodiment of the invention.
Figure 10:
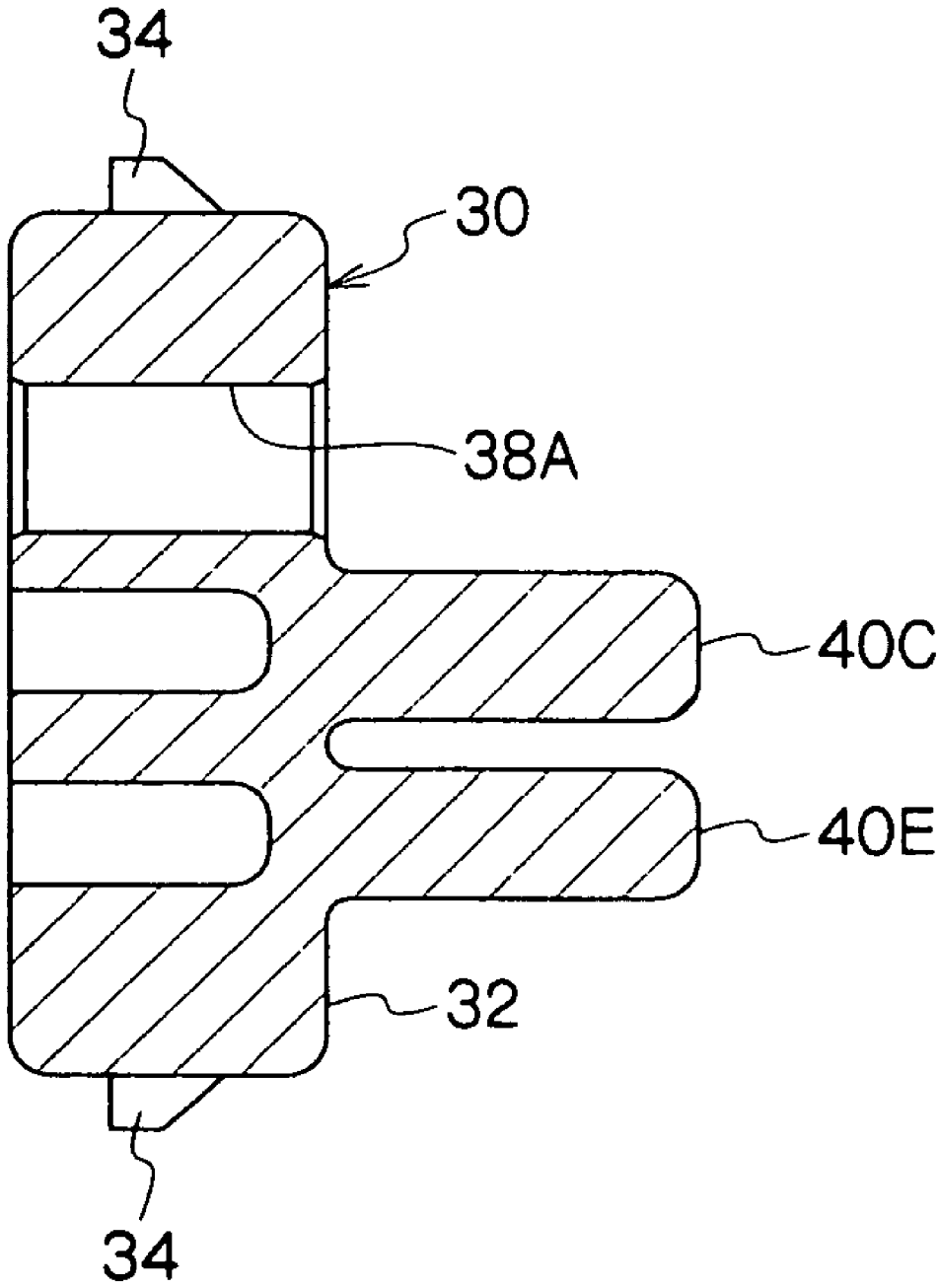
FIG. 10 is a cross-sectional view showing the structure of the holder as a constructing member of the waterproof connector according to the embodiment of the invention.
Figure 11:
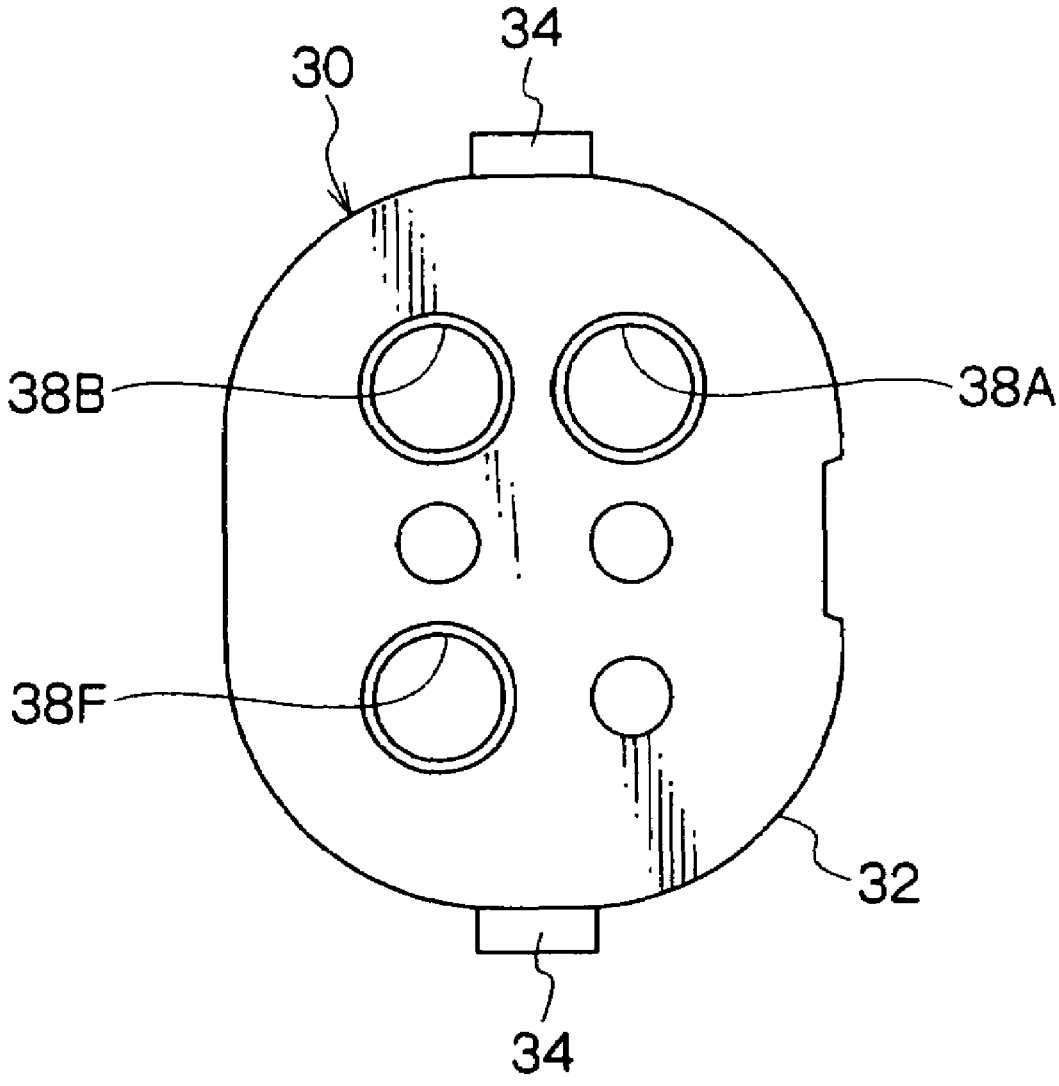
FIG. 11 is a rear view showing the structure of the holder as a constructing member of the waterproof connector according to the embodiment of the invention.

The fitting hole 18 is provided therein with a waterproof plug 22 made of an elastic material such as rubber. As shown in FIGS. 5 to 7, the waterproof plug 22 is formed in a cylindrical shape in which the axial direction dimension of elliptical cross section corresponding to the shape of the fitting hole 18 is short and is fitted in the fitting hole 18. The waterproof plug 22 is formed in its outer circumferential portion with plural fold portions 24. The plural fold portions 24 elastically deformed in a predetermined amount are contacted with the inner circumferential surface of the fitting hole 18. This can prevent drops of water from entering the housing 12 from the outside through between the outer circumference of the waterproof plug 22 and the inner circumference of the fitting hole 18.

The waterproof plug 22 is formed with six first electric wire insertion holes 26A, 26B, 26C, 26D, 26E, and 26F in positions corresponding to the six holding holes 16A, 16B, 16C, 16D, 16E, and 16F of the housing 12. The first electric wire insertion holes 26A, 26B, 26C, 26D, 26E, and 26F are formed therein with plural fold portions 28, respectively. The electric wires 20A, 20B, and 20F connected to the terminal fittings 14A, 14B, and 14F are inserted into the first electric wire insertion holes 26A, 26B, and 26F corresponding to the holding holes 16A, 16B, and 16F. The plural fold portions 28 elastically deformed in a predetermined amount are contacted with the outer circumferential surfaces of the electric wires 20A, 20B, and 20F. This can prevent drops of water from entering the housing 12 from the outside through the first electric wire insertion holes 26A, 26B, and 26F into which the electric wires 20A, 20B, and 20F are inserted.

A holder 30 formed of a resin material is provided on the opposite side of the plural holding holes 16A, 16B, 16C, 16D, 16E, and 16F through the waterproof plug 22. As shown in FIGS. 8 to 11, the holder 30 has a body portion 32 formed in a cylindrical shape in which the axial direction dimension of elliptical cross section corresponding to the shape of the fitting hole 18 is short. The body portion 32 is fitted in the fitting hole 18. A pair of engaging pawls 34 is protruded from the outer circumferential portion of the body portion 32. The pair of engaging pawls 34 are engaged into a pair of engaging holes 36 formed at one end of the housing 12. The body portion 32 is engaged to the housing 12 in the fitting hole 18. The body portion 32 holds the waterproof plug 22 in a predetermined position (or prevents the waterproof plug 22 from falling from the housing 12).

The body portion 32 is formed with second electric wire insertion holes 38A, 38B, and 38F in positions corresponding to the first electric wire insertion holes 26A, 26B, and 26F into which the electric wires 20A, 20B, and 20F are inserted. The electric wires 20A, 20B, and 20F inserted into the first electric wire insertion holes 26A, 26B, and 26F are inserted into the second electric wire insertion holes 38A, 38B, and 38F.

Cylindrical fitting protrusions 40C, 40D, and 40E are integrally protruded from the body portion 32 in positions corresponding to the unused first electric wire insertion holes 26C, 26D, and 26E into which the electric wires are not inserted. The fitting protrusions 40C, 40D, and 40E are fitted in the first electric wire insertion holes 26C, 26D, and 26E, respectively. Plural ribbed portions 28 formed in the first electric wire insertion holes 26C, 26D, and 26E and elastically deformed in a predetermined amount are contacted with the outer circumferential surfaces of the fitting protrusions 40C, 40D, and 40E. This can prevent drops of water from entering the housing 12 from the outside through the first electric wire insertion holes 26C, 26D, and 26E.

The operation of this embodiment will now be described.

In the above-structured waterproof connector 10, the waterproof plug 22 is fitted in the fitting hole 18 of the housing 12 and the plural fold portions 24 formed in the outer circumferential portion of the waterproof plug 22 are contacted with the inner circumferential surface of the fitting hole 18. This can prevent drops of water from entering the housing 12 from the outside through between the inner circumference of the fitting hole 18 and the outer circumference of the waterproof plug 22.

The three first electric wire insertion holes 26A, 26B, and 26F into which the electric wires 20A, 20B, and 20F are inserted, of the six first electric wire insertion holes 26A, 26B, 26C, 26D, 26E, and 26F of the waterproof plug 22 are closed by the electric wires 20A, 20B, and 20F. The fold portions 28 are contacted with the outer circumference portions of the electric wires 20A, 20B, and 20F. This can prevent drops of water from entering the housing 12 from the outside through the first electric wire insertion holes 26A, 26B, and 26F.

The fitting protrusions 40C, 40D, and 40E of the holder 30 are fitted in the remaining unused first electric wire insertion holes 26C, 26D, and 26E of the waterproof plug 22. The fold portions 28 are contacted with the outer circumferential surfaces of the fitting protrusions 40C, 40D, and 40E. This can prevent drops of water from entering the housing 12 from the outside through the unused first electric wire insertion holes 26C, 26D, and 26E.

In the waterproof connector 10, no drops of water can enter the housing 12 from the outside through the fitting hole 18.

In the waterproof connector 10, the fitting protrusions 40C, 40D, and 40E fitted in the unused first electric wire insertion holes 26C, 26D, and 26E of the waterproof plug 22 are integrally provided in the body portion 32 of the holder 30 preventing the waterproof plug 22 from falling from the housing 12. For instance, the waterproof connector 10 can prevent the number of components from being increased as compared with the case of inserting specially-set sealing pins as separate components into the unused first electric wire insertion holes 26C, 26D, and 26E. The body portion 32 of the holder 30 is assembled into the housing so as to fit the fitting protrusions 40C, 40D, and 40E in the unused first electric wire insertion holes 26C, 26D, and 26E. Therefore, it is possible to prevent the number of assembling processes from being increased.

In the waterproof connector 10, the fitting protrusions 40C, 40D, and 40E fitted in the unused first electric wire insertion holes 26C, 26D, and 26E of the waterproof plug 22 are integrally provided in the body portion 32 of the holder 30 engaged to the housing 12 by the pair of the engaging pawls 34 and the pair of the engaging holes 36. The fitting protrusions 40C, 40D, and 40E can be reliably held in the unused first electric wire insertion holes 26C, 26D, and 26E.

Figure 12:
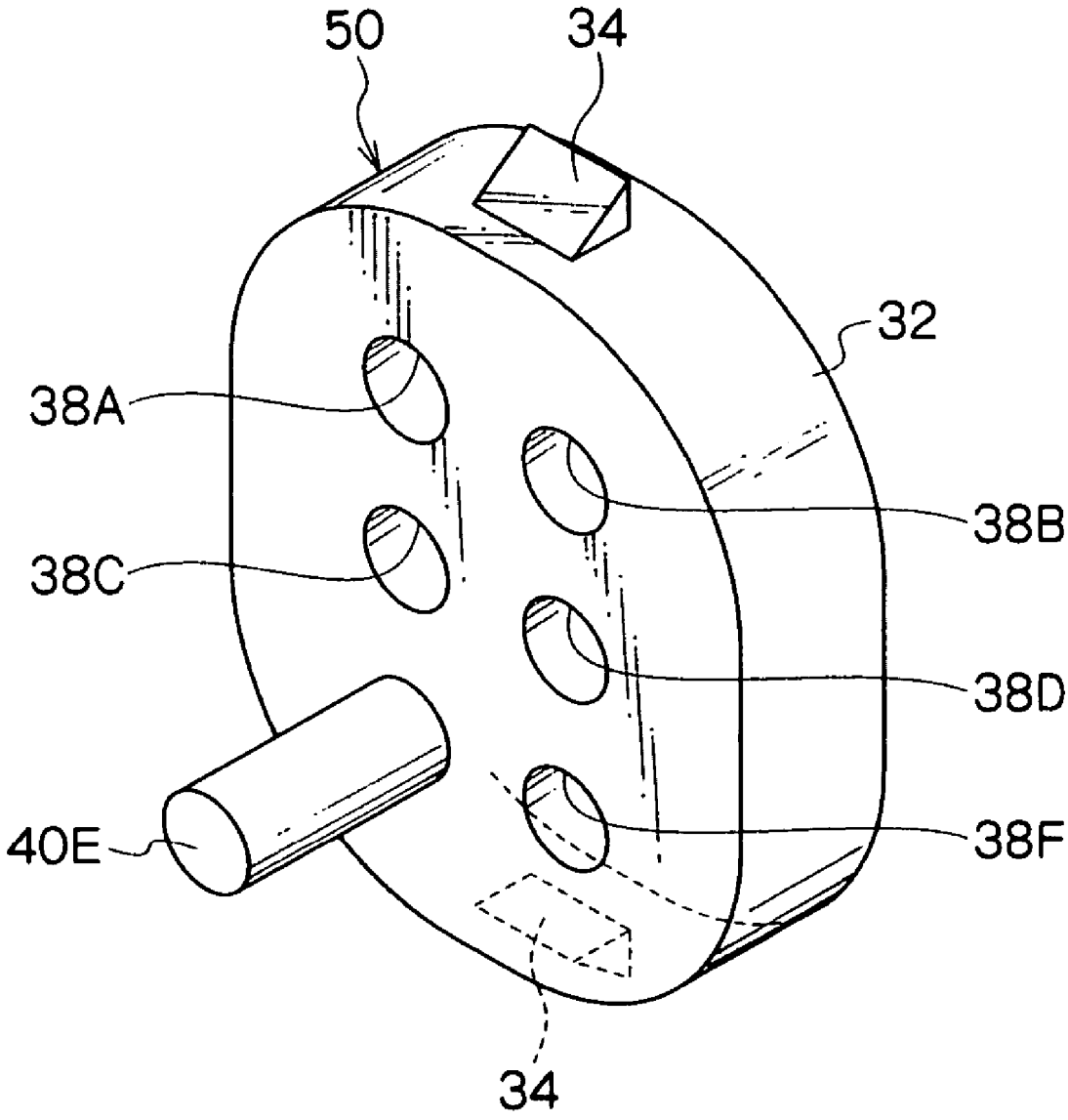
FIG. 12 is a perspective view showing the structure of a modification example of a holder as a constructing member of the waterproof connector according to the embodiment of the invention.

As described above, the terminal fittings 14A, 14B, and 14F are fitted in the three holding holes 16A, 16B, and 16F of the six holding holes 16A, 16B, 16C, 16D, 16E, and 16F of the housing 12. For instance, when the terminal fittings 14 are fitted in the five holding holes 16A, 16B, 16C, 16D, and 16F of the six holding holes 16A, 16B, 16C, 16D, 16E, and 16F of the housing 12, a holder 50 as shown in FIG. 12 is applied to the waterproof connector 10 in place of the holder 30.

The holder 50 basically has the same structure as that of the holder 30 and has the second electric wire insertion holes 38C and 38D in place of the fitting protrusions 40C and 40D of the holder 30. The electric wires connected to the terminal fittings 14 fitted in the holding holes 16C and 16D and inserted into the first electric wire insertion holes 26C and 26D of the waterproof plug 22 are inserted into the second electric wire insertion holes 38C and 38D.

In the waterproof connector 10, by changing the holder, which can be inexpensively molded by a resin material, (changing the number of the second electric wire insertion holes and the number of the fitting protrusions) the number of the terminal fittings 14 can be varied as appropriate in the range of 1 to 6, and the expensive waterproof plugs 22 made of rubber can be used as a common part.

As described above, the waterproof connector 10 according to the embodiment of the invention can prevent drops of water from entering the housing 12 through the unused electric wire insertion holes 26C, 26D, and 26E of the waterproof plug 22 and can suppress an increase in the number of components and the number of assembling processes.

In the waterproof connector 10 according to the above embodiment, the housing 12 is formed with the six holding holes 16 capable of holding the terminal fittings, which does not limit the invention.

What is claimed is:

1. A method of assembling a waterproof connector comprising the steps of:

providing a housing, formed therein with a plurality of holding portions capable of holding terminal fittings so that a predetermined number of the plurality of holding portions hold the terminal fittings, and formed at one end with a fitting hole communicating the plurality of holding portions with the outside, with electric wires connected to the held terminal fittings being inserted into the fitting hole;

fitting a waterproof plug in the fitting hole that has a plurality of first electric wire insertion holes formed corresponding to the plurality of holding portions such that one or more electric wires may be inserted into one or more of the first electric wire insertion holes corresponding to the predetermined number of the holding portions holding the terminal fittings, wherein said plug prevents drops of water from entering the housing through the fitting hole from points other than unused first electric wire insertion holes not inserted with the electric wires;

providing a plurality of holders, each of which has a body portion engageable to the one end of the housing so as to prevent the waterproof plug from detaching from the housing, and second electric wire insertion holes formed in the body portion, wherein electric wires inserted into the first electric wire insertion holes are inserted through the second electric wire insertion holes, each holder also having a predetermined pattern of fitting protrusions integrally formed on the body portion to be fitted into the unused first electric wire insertion holes, wherein the fitting protrusions prevent drops of water from entering the housing through the unused first electric wire insertion holes, and wherein different ones of said plurality of holders have different, predetermined patterns of second electric wire insertion holes and fitting protrusions;

selecting one of the plurality of holders having a predetermined pattern of second wire insertion holes that corresponds to the pattern of held terminal fittings in said housing, and engaging said selected holder into said one end of said housing such that the fitting protrusions of said holder are fitted into all unused first electric wire insertion holes wherein said fitting protrusions are formed to be solid in each of said plurality of holders.

* * * * *